US010815025B2

(12) United States Patent
Kalberer et al.

(10) Patent No.: US 10,815,025 B2
(45) Date of Patent: Oct. 27, 2020

(54) GABLE TOP WITH SPOUT CLOSURE

(71) Applicant: EVERGREEN PACKAGING, INC., Memphis, TN (US)

(72) Inventors: Roderick W. Kalberer, Waynesville, NC (US); Norsen Steen, Memphis, TN (US)

(73) Assignee: EVERGREEN PACKAGING LLC, Memphis, TN (US)

( * ) Notice: Subject to any disclaimer, the term of this patent is extended or adjusted under 35 U.S.C. 154(b) by 0 days.

(21) Appl. No.: 15/436,010

(22) Filed: Feb. 17, 2017

(65) Prior Publication Data

US 2017/0240316 A1 Aug. 24, 2017

Related U.S. Application Data

(60) Provisional application No. 62/296,657, filed on Feb. 18, 2016.

(51) Int. Cl.

| | |
|---|---|
| ***B65D 5/74*** | (2006.01) |
| ***B65D 5/06*** | (2006.01) |
| ***B65D 5/42*** | (2006.01) |
| ***B65D 5/64*** | (2006.01) |
| ***B65D 85/72*** | (2006.01) |

(52) U.S. Cl.

CPC ..... *B65D 5/746* (2013.01); *B65D 5/067* (2013.01); *B65D 5/4266* (2013.01); *B65D 5/64* (2013.01); *B65D 85/72* (2013.01)

(58) Field of Classification Search

CPC ..... B65D 5/067; B65D 5/4266
USPC ..... 229/125.15, 213, 249, 125.42, 915.1
See application file for complete search history.

(56) References Cited

U.S. PATENT DOCUMENTS

| | | | | |
|---|---|---|---|---|
| 4,192,446 | A * | 3/1980 | Naito | B65D 5/061 229/137 |
| 4,795,086 | A * | 1/1989 | Farber | B65D 5/064 229/137 |
| 4,955,531 | A | 9/1990 | Graboyes | |
| 5,085,323 | A | 2/1992 | Kuchenbecker | |
| 5,636,785 | A * | 6/1997 | Kalberer | B65D 5/067 229/125.15 |
| 5,803,349 | A * | 9/1998 | Ljungstrom | B65D 5/068 229/125.42 |
| 8,403,820 | B2 | 3/2013 | Zoeckler | |
| 9,227,750 | B2 | 1/2016 | Franic | |

(Continued)

FOREIGN PATENT DOCUMENTS

WO WO2013151806 A1 10/2013

OTHER PUBLICATIONS

International Search Report and Written Opinion; dated Jun. 15, 2017 13 pages.

*Primary Examiner* — Derek J Battisti
(74) *Attorney, Agent, or Firm* — Vedder Price P.C.

(57) ABSTRACT

A gable top carton and a carton blank for forming a gable top carton are provided having patterns of score lines positioned beneath a closure aperture that relieve stress during a folding operation to better allow the carton blank to be formed into a suitable gable top container. The score pattern is particularly useful for cartons where the closure assembly has a flange which may touch or overlap with one of the walls of the front face panel of the assembled carton and respective portion of the carton blank.

23 Claims, 11 Drawing Sheets

(56) References Cited

U.S. PATENT DOCUMENTS

| | | | | |
|---|---|---|---|---|
| 2001/0008252 | A1* | 7/2001 | Ammons | B31B 50/00 229/184 |
| 2006/0144912 | A1* | 7/2006 | Franic | B65D 5/029 229/125.15 |
| 2011/0113733 | A1* | 5/2011 | Franic | B65D 5/029 53/452 |
| 2014/0001248 | A1 | 1/2014 | Wong et al. | |
| 2015/0360819 | A1* | 12/2015 | Wieser | B65D 5/067 206/524.3 |

* cited by examiner

GABLE TOP WITH SPOUT CLOSURE

RELATED APPLICATIONS

This application claims the benefit of U.S. Provisional Application Ser. No. 62/296,657 filed on Feb. 18, 2016 and which is incorporated herein by reference.

BACKGROUND OF THE INVENTION

This invention relates to paperboard containers and more particularly to a gable top container of the type used for the packaging of milk, fruit juice, and other pourable food and non-food products. The tops of such containers include a vertical and uppermost fin which joins the upper edges of two slanting roof panels. An infolded gusset panel is beneath each of the two fin ends. The containers have in the past been square or rectangular in transverse cross section and have recently been provided with a spout closure on one of the two top slanting roof panels.

The available space for placing a spout, closure on either of the two slanting roof panels is dictated by the slant roof panel distance from the upstanding vertical fin to the top of the corresponding vertical side wall. On large paperboard containers such as half gallon gable top cartons, a relatively large spout closure can be used on the slanting roof panel that is easily manipulated by the consumer and offers a sufficiently large opening such that contents can flow easily through the spout closure. However, as the volume size of a gable top carton is reduced, the available surface area for the spout closure on the roof panel is significantly reduced. For certain size cartons, such as a single serve carton, the position of a standard size spout closure on the roof panel could interfere with the folding of the carton blank into a carton.

There are a variety of gable top cartons having spout closures and which teach the construction of a carton blank and folded gable top carton. Two representative patents include U.S. Pat. Nos. 5,636,785 and 9,227,750 both in which are incorporated herein by reference.

SUMMARY OF THE INVENTION

According to one aspect of at lest one embodiment of this invention, a gable top carton having a spout closure is formed to exhibit a square transverse section, and the gusset panels which lie beneath the slanting top panels are extensions of a pair of sidewall panels. In some embodiments, a pattern of multiple score lines is positioned on a panel surface below the opening for a spout closure. The patterns of multiple score lines are designed to relieve stress during a folding operation and allow the carton blank to be formed into a gable top container using standard manufacturing equipment and speeds. The score lines facilitate the bending of the panel upon folding and forming the carton. The carton, formed from a unitary paperboard blank, may be conventionally coated with one or more barrier polymer layers, including polyethylene. Using this construction, the largest possible diameter spout closure may be attached to one of these roof panels.

According to one aspect of at least one embodiment of the present invention, a gable top carton may be provided of a unitary paperboard blank, the carton including a gable top having a pair of oppositely disposed slanted roof panels and an upstanding vertical fin, the carton defining a closure opening aligned with a spout closure, the closure opening and spout closure located on one of the slanting roof panels, a wall panel beneath the spout closure defining a pattern of score lines, wherein the individual score lines defining the panel do not engage any score lines defining a roof panel or side wall panel.

According to one aspect of at least one embodiment of the present invention, a carton blank may be provided from a unitary blank of stiff, resilient and foldable sheet material, the blank adapted to be folded to form a tube and adapted to contain a pourable product, the blank including first, second, third, and fourth parallel wall forming panels serially side by side foldably joined together and each having a top end closure panel, the wall forming panels being of the same width, each said top end closure panel being generally rectangular, the top end closure panels being foldably joined to each other and having at an upper end of each a respective fin forming panel, the fin forming panels of the first and third side wall panels each having a free edge, the first and third top end closure panels each having a pair of intersecting fold lines to form a respective infolded gusset panel, and a roof panel forming an aperture adapted for receiving a spout closure, the wall forming panel beneath the aperture defining a score line pattern discontinuous with any score lines forming the perimeter of the wall forming panel or the roof panel defining the aperture.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It, is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
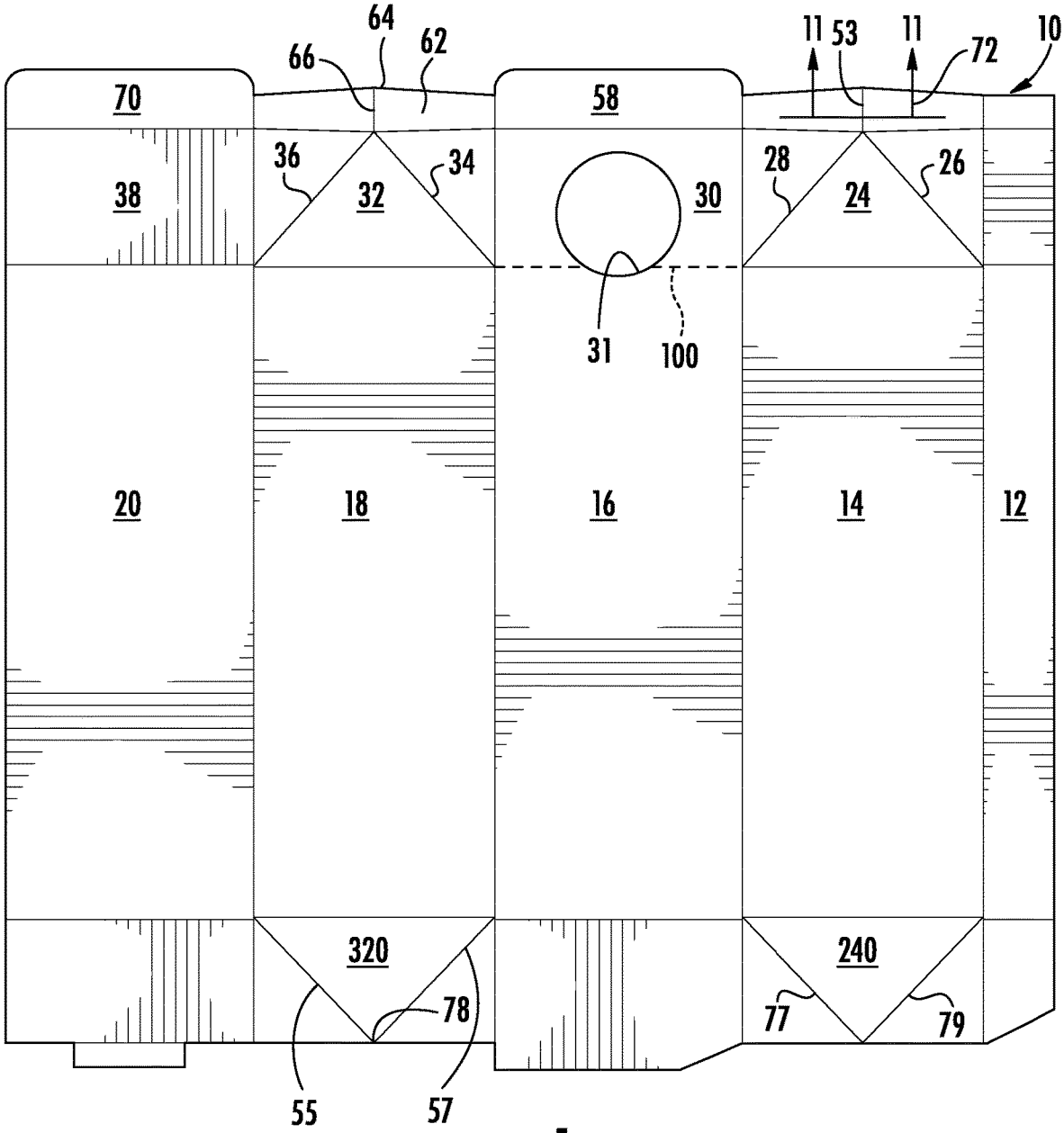
FIG. 1 is a plan view of a unitary blank of paperboard for forming the gable top container of this invention utilizing no scoring below the spout closure opening.

Referring now to FIG. 1, a unitary blank of paperboard 10 is illustrated. Typically the paperboard is coated on one or both sides with one or more barrier layers, including a thermoplastic outer layer. The blank includes four serially arranged panels 14, 16, 18, and 20, with panel 12 being a side seam which enables the four main panels to form a rectangular tube. A first gusset panel 24 having slanted score lines 26 and 28 is positioned above first side wall panel 14. A first slanting roof panel 30, having an aperture 31, is positioned above second side wall panel 16. A second gusset panel 32, having slanted score or fold lines 34 and 36 is positioned above third side wall panel 18. A second slanting roof panel 38 is positioned, above fourth side wall forming panel 20. A first upper sealing panel 42 is positioned above gusset forming panel 24.

Fin forming panels 58, 62, and 70 and 72 are longitudinally serially joined and form the usual vertical fin of the gable top carton.

Panel 62 is horizontally aligned with panel 58, the latter horizontally aligned with panel 72, with the midpoint of panel 62 including a V forming extension or peak 64, similar to V extension 54 of panel 72. The midpoint of peak 64 is provided with a vertical score line 66. Panel 70 is horizontally aligned with panel 62, with panel 70 being above the second slanting roof forming top closure forming panel 38. These panels, as well as other panels described, are formed by the indicated fold lines, not all of which bear reference numerals.

The bottom closure forming portion of blank 10 includes at the bottom of panel 14 a lower gusset panel 240, similar to panel 24, and having the indicated slanted and intersecting score lines. The tip of panel 240 is formed by the intersection of slanted lines 77 and 79. Lower gusset forming panel 320 is also used for the bottom closure and is similar to gusset panel 32 and defining score lines 55 and 57, with panel 320 including a tip 78 for forming a V point.

The blank of FIG. 1 may be folded into a gable configuration by heat sealing panel 12 to an opposite portion of side wall forming panel 20 and roof panel 28 and the bottom left (unnumbered) bottom closure panel. Oppositely facing gusset forming panels 24 and 32, may be formed along with the conventional gable carton vertical top fin including sealed together upper fin, panels 58 and 70 at the upper ends of slanting roof panels 30 and 38. Panels 42 and 62 are also fin forming panels, being sandwiched by fin forming panels 58 and 70.

Figure 2:
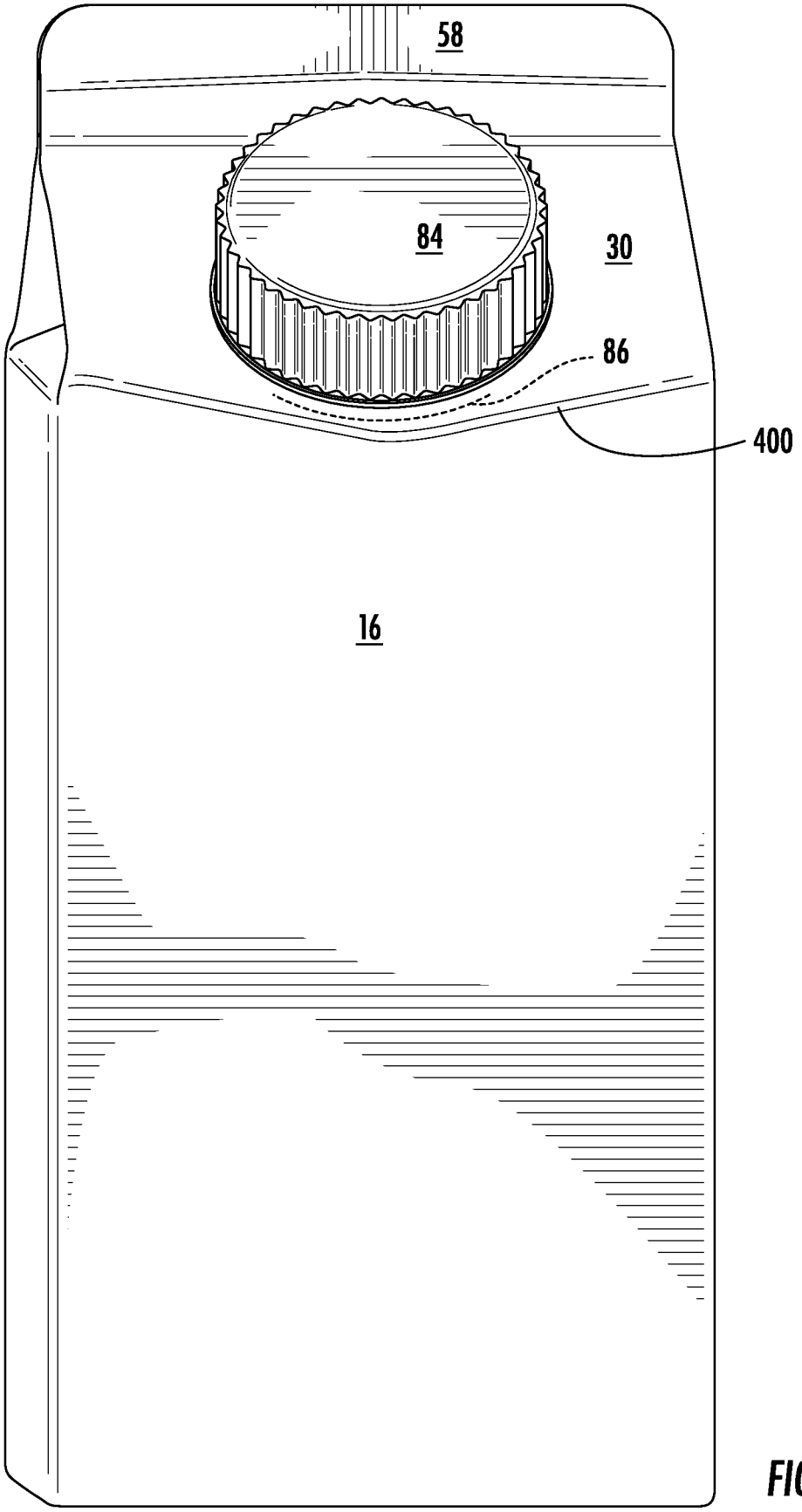
FIG. 2 is a view illustrating the top of a container fashioned from the blank of FIG. 1 after it has been heat sealed and set up to form a carton with a spout closure.

As seen in FIG. 2, a conventional plastic spout closure having a cap 84 and flange 86 is illustrated and in relation to roof top panel 30 and wall panel wall panel 16. In practice, the spout closure may be applied to the outside of the carton over and aligned with spout opening 31, (FIG. 1) with flange 86 on the outside, or may be applied from the carton interior through opening 31, with flange 86 on the inside.

In all of the embodiments described herein, the unitary blank of paperboard can be provided having a thickness of between about 0.012 inches to about 0.019 inches. It is also envisioned that variations in the board caliper are possible depending upon coating layers or additional substrate layers applied to the board. For instance, the inclusion of an inner foil liner on a carton would allow the use of a thinner paperboard substrate. Accordingly, it is envisioned within the scope of this invention that paperboard blanks and resulting cartons can also include a barrier layer of foil or similar material.

In reference to the score pattern embodiments of the present invention, each score pattern defines a width, as measured from the greatest distance along a horizontal axis between respective score line portion edges, where the width of the pattern is greater than a height of the score pattern, the height being the greatest top to bottom distance along any vertical axis. Additionally, for the score pattern embodiments described herein, the distance from the aperture edge to the closest portion of a scored member of a score pattern is less than the distance from any lateral panel side seam to the closest portion of a scored member of the scoring pattern.

As referenced in FIG. 1, dashed lines 100 refer to an extension of a plane of the adjacent score lines separating panel 14 and 24 and panels 18 and 32 respectfully. As seen in reference to FIG. 1 and the assembled carton shown in FIG. 2, the aperture for the spout closure can extend into where a normal boundary score line would be present along dashed lines 100 between panel 16 and panel 30. It has surprisingly been found that a carton blank according to FIG. 1, along with an installed spout closure, can be folded into a gable top configuration as seen in FIG. 2 without having any scoring present in the boundary area between panel 16 and panel 30. The ability to fold a gable top carton having an aperture present in panel 30 and having dimensions that extend in part into a side panel 16 allows the use of large fitments on a small, i.e. 500 ml, gable top carton. The assembled carton has a slight curvature 400 below the spout closure and in an area between panel 16 and panel 30, curvature 400 may be partially deformed in order to accommodate the folding of the panel around the spout closure using conventional folding equipment and processing speeds. While the curvature 400 does not impair the ability of the carton to retain product or maintain freshness, for some industries, the slight deformation is not preferred by consumers.

Referring now to FIGS. 3, 5, 7, and 9 blanks are shown which is the same as that of FIG. 1, except for the different construction of first panel 16 of FIG. 1 setting forth a pattern 110 of score lines defined within panel 16.

Referring now to FIGS. 4, 6, 8 and 10 cartons are similar to that of FIG. 2 are shown but for the different construction of additional score lines formed in first panel 16 and below the spout closure opening 31 formed within panel 30.

Figure 11:
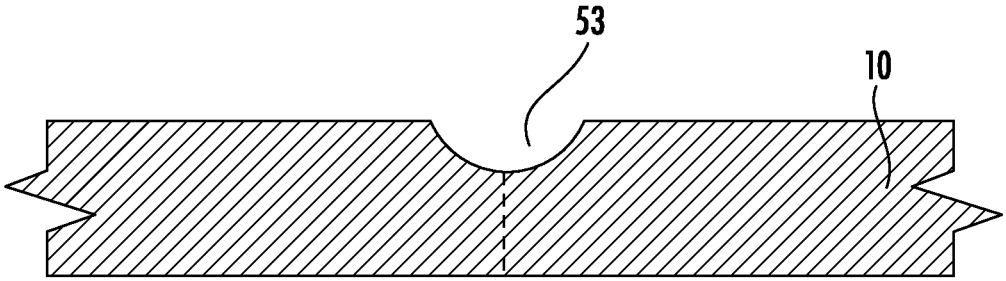
FIG. 11 is a view taken along section 11-11 of FIG. 1 setting forth details of a score line.

As used herein, the term score line is used in reference to a predetermined area of weakness such as a single score line 53 as seen in FIG. 11 and which may extend about halfway through the paperboard to facilitate the deformation of panel 1. The score line is preferably not a cut line but provides a crease or depression to the scored surface, as seen in reference to FIG. 11, which maintains the integrity of the paperboard coatings.

The scoring operation for a carton blank typically occurs during a converting stage where the carton blank is die cut, appropriate scoring is applied to a surface of the carton blank and the blank is frequently formed into a side sealed carton or sleeve. Following the scoring operation, the carton blank is placed within a mechanical applicator for the installation of the spout closure which includes an ultrasonic welding step to bond the spout flange to the carton.

The final folding and filling operations of the carton are where the pattern 110 of multiple score lines facilitates the assembly of the gable top carton having the bonded spout flange secured to the carton. The pattern of score lines significantly reduces the severity of the curvature 400 present in assembled cartons such as those set forth in FIGS. 4, 6, 8 and 10.

In reference to the blank shown in FIG. 3 and the corresponding carton shown in FIG. 4, there is a pattern 110 of multiple score lines positioned in panel 16 and below an area of the opening 31 of the spout closure and the cap 84 and flange 86 of the spout closure opening 81 may extend partially into a portion of side panel 16. As illustrated, the scoring comprises two intersecting score lines forming an X pattern followed by a third lower score line having an angled orientation that is parallel to the two intersecting score lines above. In reference to FIG. 3, the three score lines are identified as 120, 121, and 122. Score lines 120 and 121 intersect along a respective mid-point of the two score lines. Score line 122 is angled so as to be a reflected image of the respective portions of the intersecting score lines 120 and 121.

Figure 3:
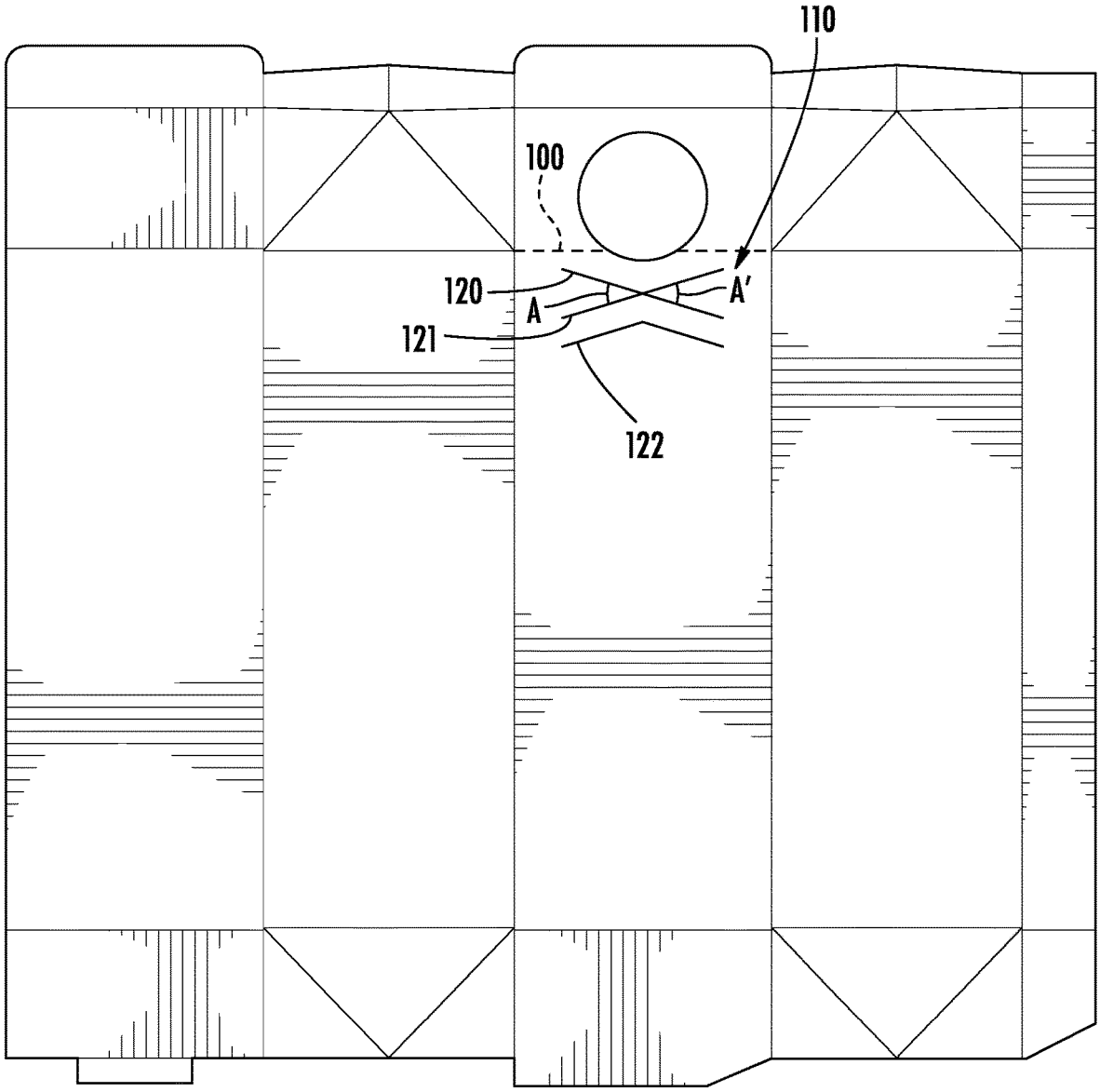
FIG. 3 is a first alternative construction of a unitary blank of paperboard for forming the gable top container of this invention utilizing scoring below spout closure opening.
Figure 4:
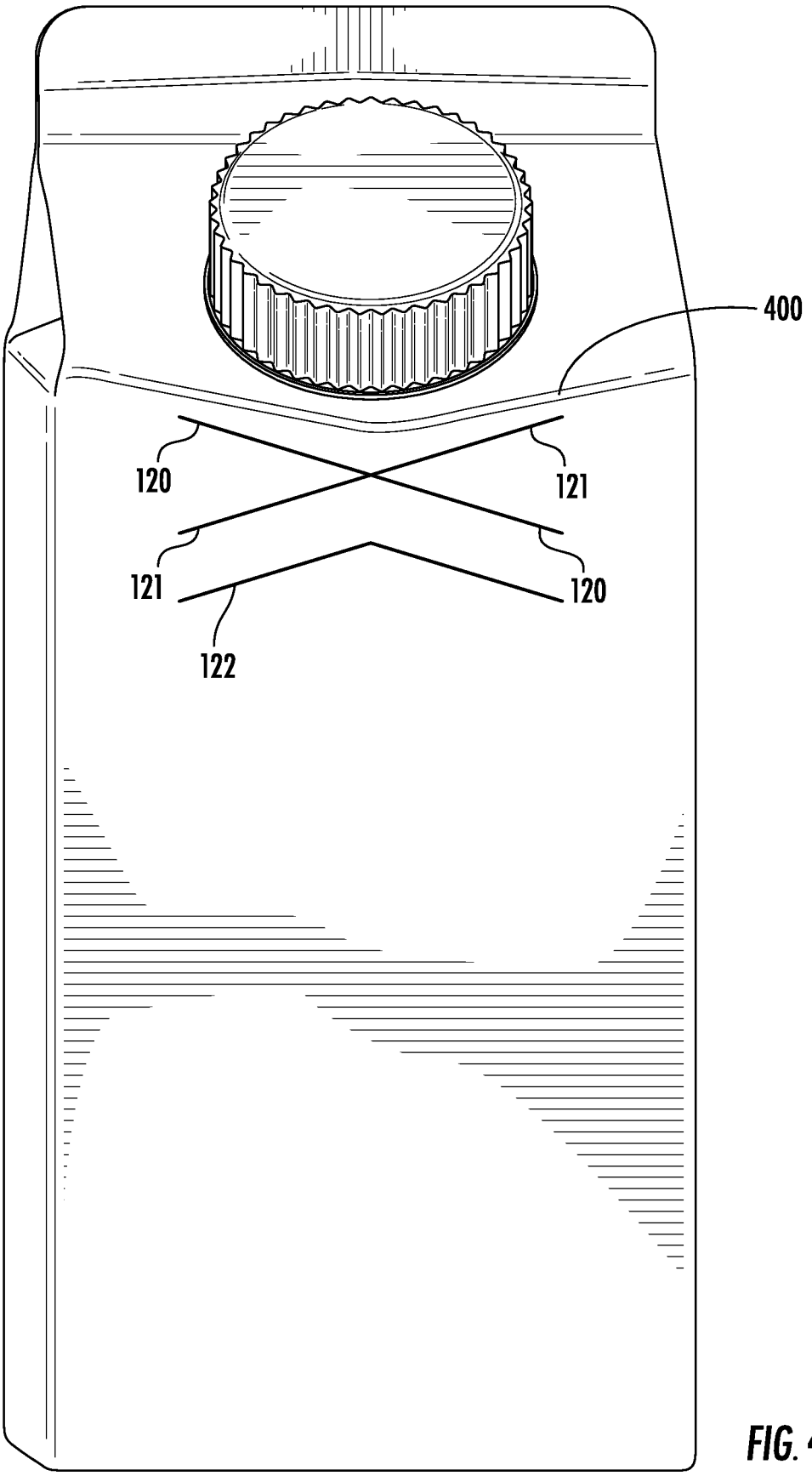
FIG. 4 a view illustrating the top of a container fashioned from the blank of FIG. 3 after it has been heat sealed and set up to form a carton with a spout closure.

As further seen in FIGS. 3 and 4 the pattern of score lines further defines a first score line 120 and second score line 121, the first and second score lines 120 and 121 intersecting at a respective mid-point of each score line, the mid-point being positioned substantially half way between the opposing side walls of the wall panel 16. A third scored region 122 defines an angle which is a reflected image of the immediate adjacent portions of the intersecting score line 120 and 121. In one embodiment, included angles A and A' defined by the intersection of the first score line 120 and the second score line 121 defines an angle of 45 degrees or less.

The score line pattern 110 does not intersect with any other score lines used to define the various panels and are positioned in their entirety below the aperture 31.

Figure 5:
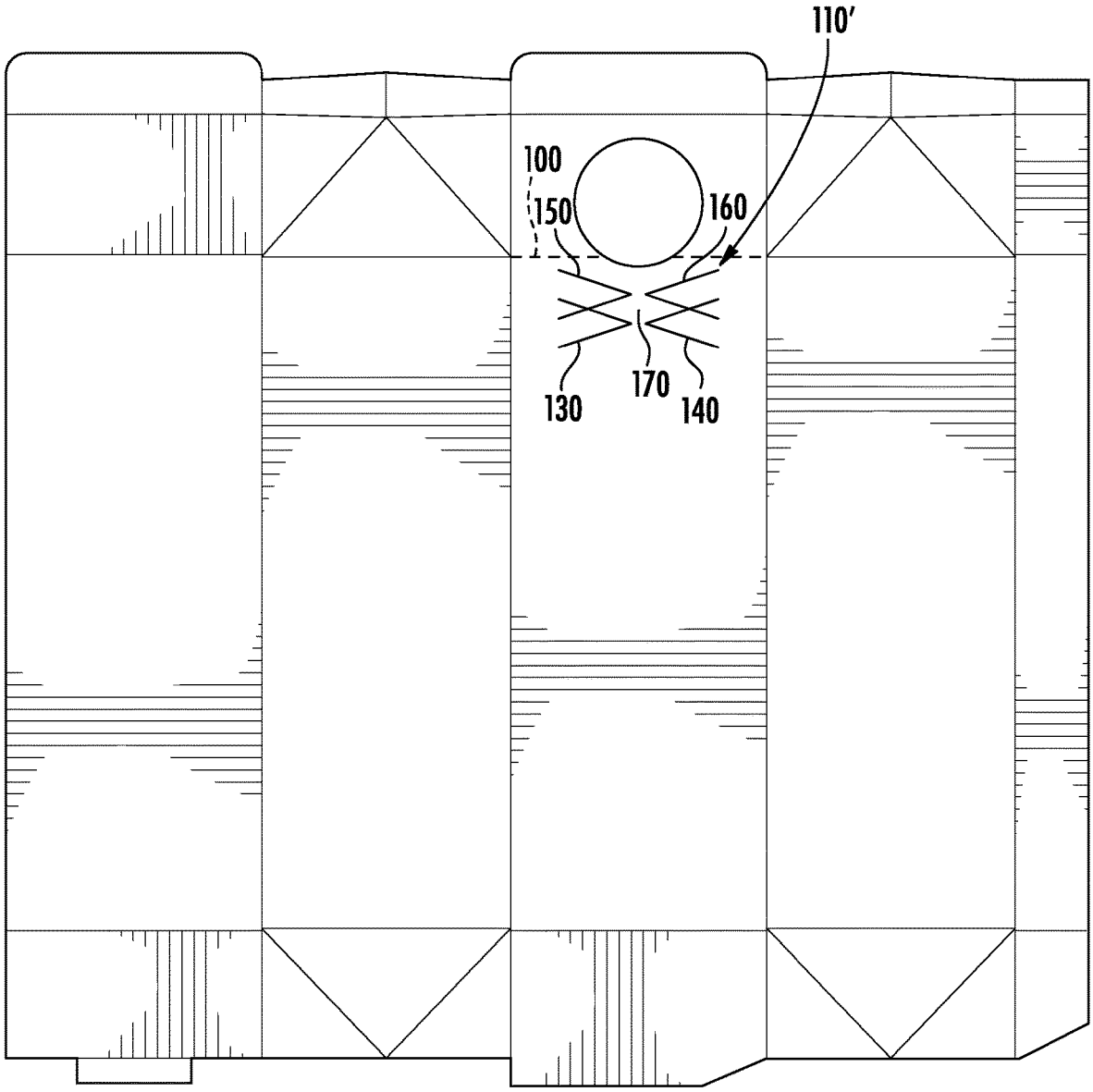
FIG. 5 is a second alternative construction of a unitary blank of paperboard for forming the gable top container of this invention utilizing scoring below the spout closure opening.
Figure 6:
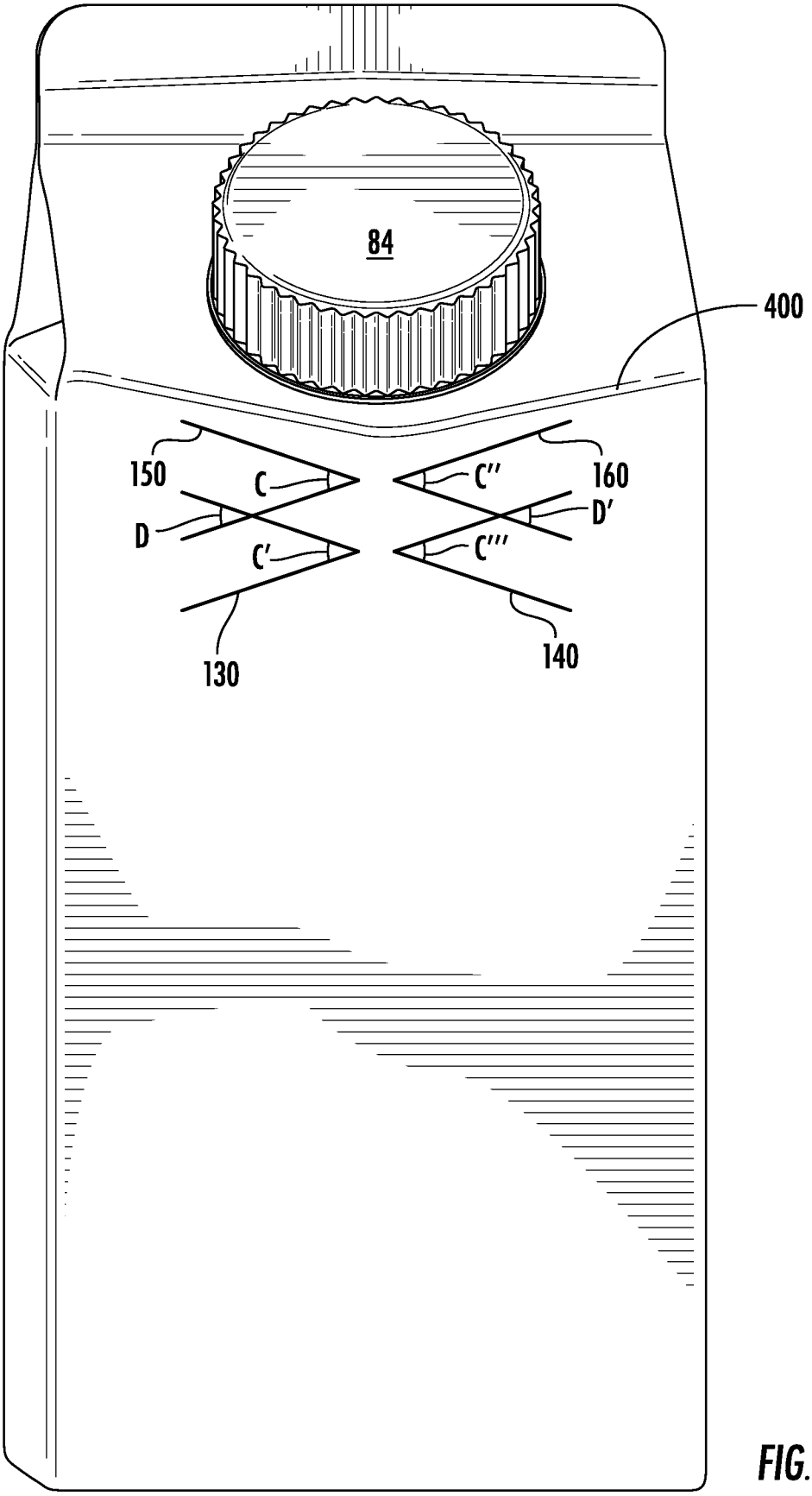
FIG. 6 is a view illustrating the top of a container fashioned from the blank of FIG. 5 after it has been heat sealed and set up to form a carton with a spout closure.

As seen in reference to FIGS. 5 and 6, the respective blank and corresponding carton are set forth showing a different score line pattern 110'. As seen in reference to FIG. 5 there are a plurality of four chevrons 130, 140, 150 and 160 which collectively defined a diamond outline 170. Chevron 150 faces chevron 160 along a common point. Similarly, chevron 130 and chevron 140 also face each other along a common point. The oppositely facing intersecting chevrons can define a brief interruption between the otherwise continuous lines of the respective chevron pairs. Alternatively, the apex of facing chevrons can be uninterrupted such that a portion of one chevron is contiguous with the adjacent and linear portion of the opposing chevron. Such uninterrupted configurations can be formed by intersecting lines such as those seen in FIG. 4 where score line 120 and 121 intersect to form opposing chevrons.

The gable top carton seen in FIG. 6 may comprise a first score region in the form of a chevron 150; and a second score region in the form of a chevron 160. Chevron 150 and 160 are spaced opposite one another with respect to an apex of the respective chevrons, the respective free ends of the first chevron and the second chevron are positioned an equal distance from the corresponding side edges of the panel 16. A third chevron 130 and a fourth chevron 160 are spaced opposite the other with respect to an apex of each chevron, the respective free ends of the third chevron and fourth chevron being positioned an equal distance from the respective side edges of the panel 16. A portion of the first and third chevron overlap and define an angle D, angle D substantial identical to angle C and C' defined by chevron 130 and 160. The second chevron and the fourth chevron intersect along an overlapping portion and define an angle D', angle D' substantially identical to angle C" and C"' defined by chevrons 140 and 150.

As illustrated, all portions of the score line pattern 110' resides beneath fitment aperture 31 and do not touch or engage any of the score lines forming the respective panels of the carton blank or assembled carton. The score line pattern 110' allows the folding of the carton blank into an assembled carton where the spout 81 closure cap and spout closure flange 83 are positioned. The respective directions of the score line, and the resulting patterns have been found to relieve stress and pressure in that area of the panel during the folding of the carton. As a result, the carton folds more easily and assumes a profile adding an attractive dimension to the front panels of the carton.

Figure 7:
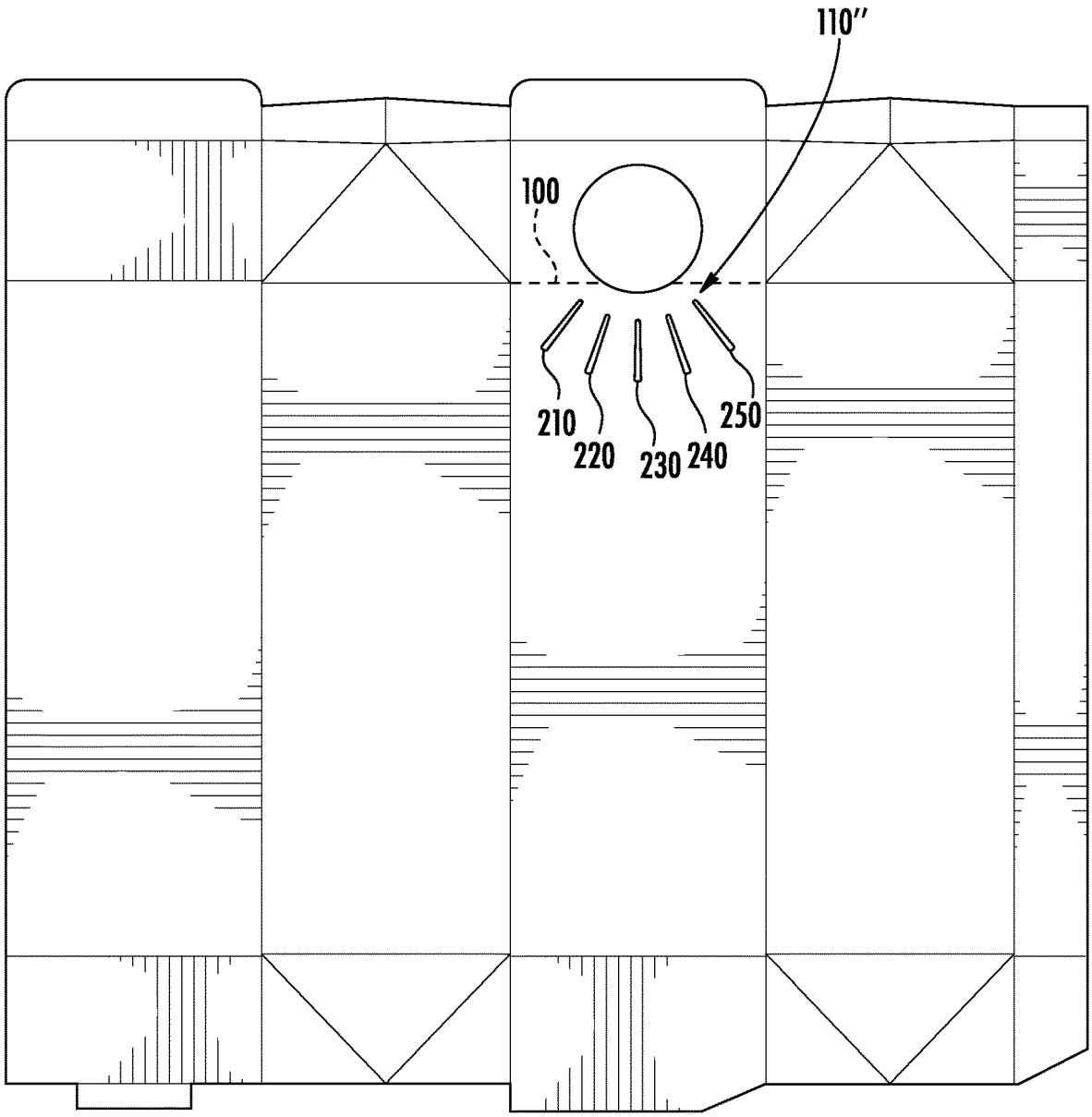
FIG. 7 is a third alternative construction of a unitary blank of paperboard for forming the gable top container of this invention utilizing scoring below the spout opening closure.
Figure 8:
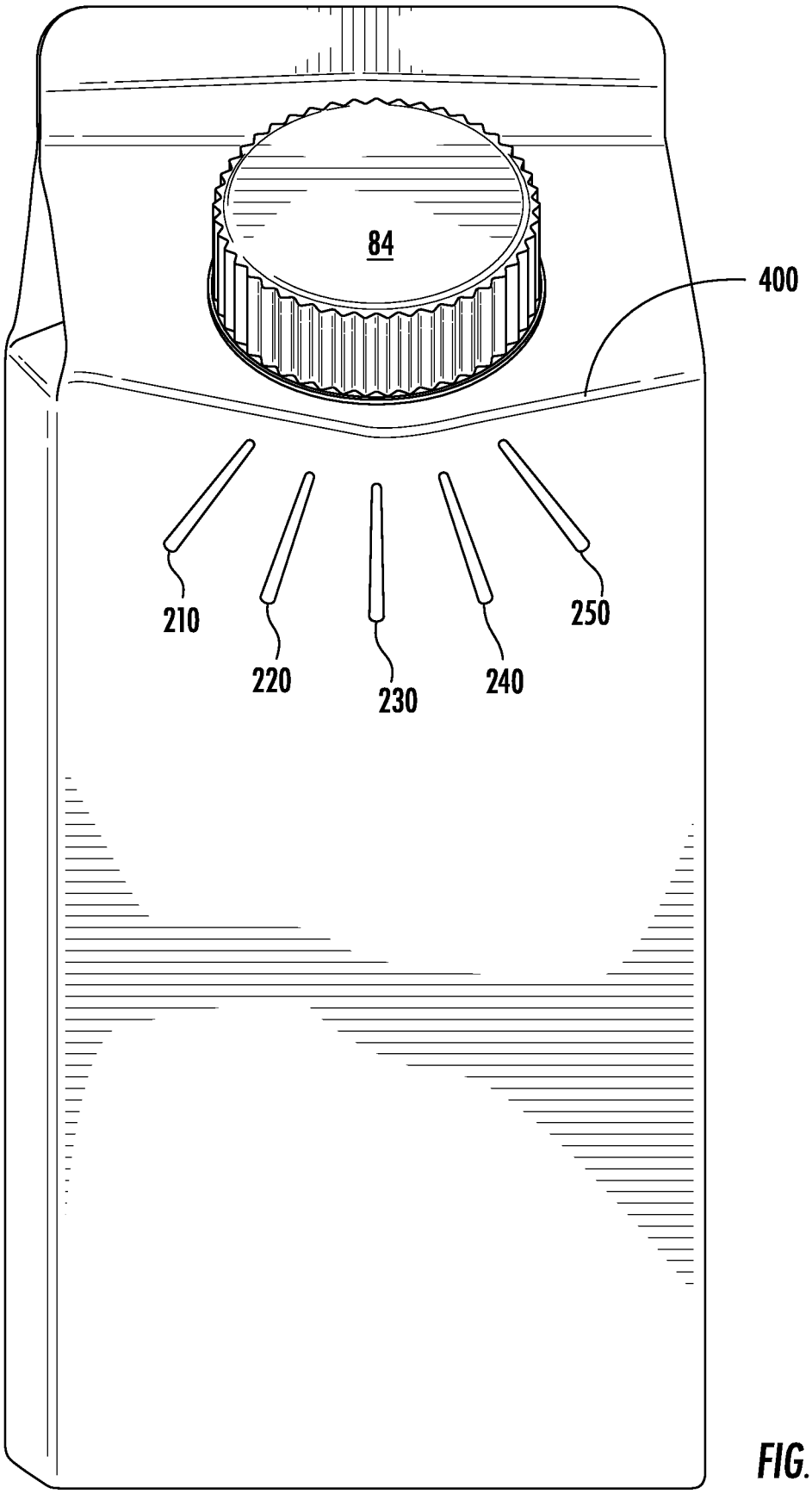
FIG. 8 is a view illustrating the top of a container fashioned from the blank of FIG. 7 after it has been heat sealed and set up to form a carton with a spout closure.

With respect to the carton blank 7 and corresponding folded carton seen in FIG. 8 a score line 110" is provided. As seen in reference to FIG. 7, the score line pattern can comprise a plurality of single scores 210, 220, 230, 240 and 250 where each score line has a terminal end pointing toward and perpendicular to the spout closure aperture 31 and spaced an equal distance and in a radial pattern from the spout closure aperture. The distal portions of the scores defining score pattern 110" may have a gradually increasing width taper running along the length of the score line as best seen in reference to FIG. 7. For instance, the proximal end of each score line can be made by a 2-point rule score or cut while a distal end has a 4-point rule cut or score. The placement and pattern of the scoring has been found useful in facilitating the folding and assembly of the carton blank, having a closure thereon, into the assembled carton as seen in reference to FIG. 8.

The gable top carton seen in FIG. 8 has a score pattern 110 defined by a plurality of at least three individual score lines, each individual score line having a first terminal end in proximity to the aperture 31 and the respective first terminal ends each being an equal distance from any adjacent terminal end.

The gable top carton score lines further defines a second terminal end, the width of the score line along the second terminal end being greater than a width of the score line at the first terminal end. Each of the plurality of at least three score lines has a width which tapers from the second terminal end to a narrower width first terminal end.

The width of the first terminal end may be a two point rule and a width of the second terminal end may be a four point rule. The respective first terminal ends are an equidistance apart and which is less than the distance defined between each of the adjacent second terminal ends such that each of the plurality of at least three individual score lines is tangential to a surface of a plane of the aperture circumference.

As further seen in reference to FIG. 7 and FIG. 8 at least one score line of the pattern 110" is positioned along a vertical axis of a midpoint of the side panel.

While a preferred embodiment as seen in FIG. 7 shows a varying width taper to the score lines comprising of pattern 110", it is believed a similar efficiency can be obtained using score lines having a uniform width along the score.

Figure 9:
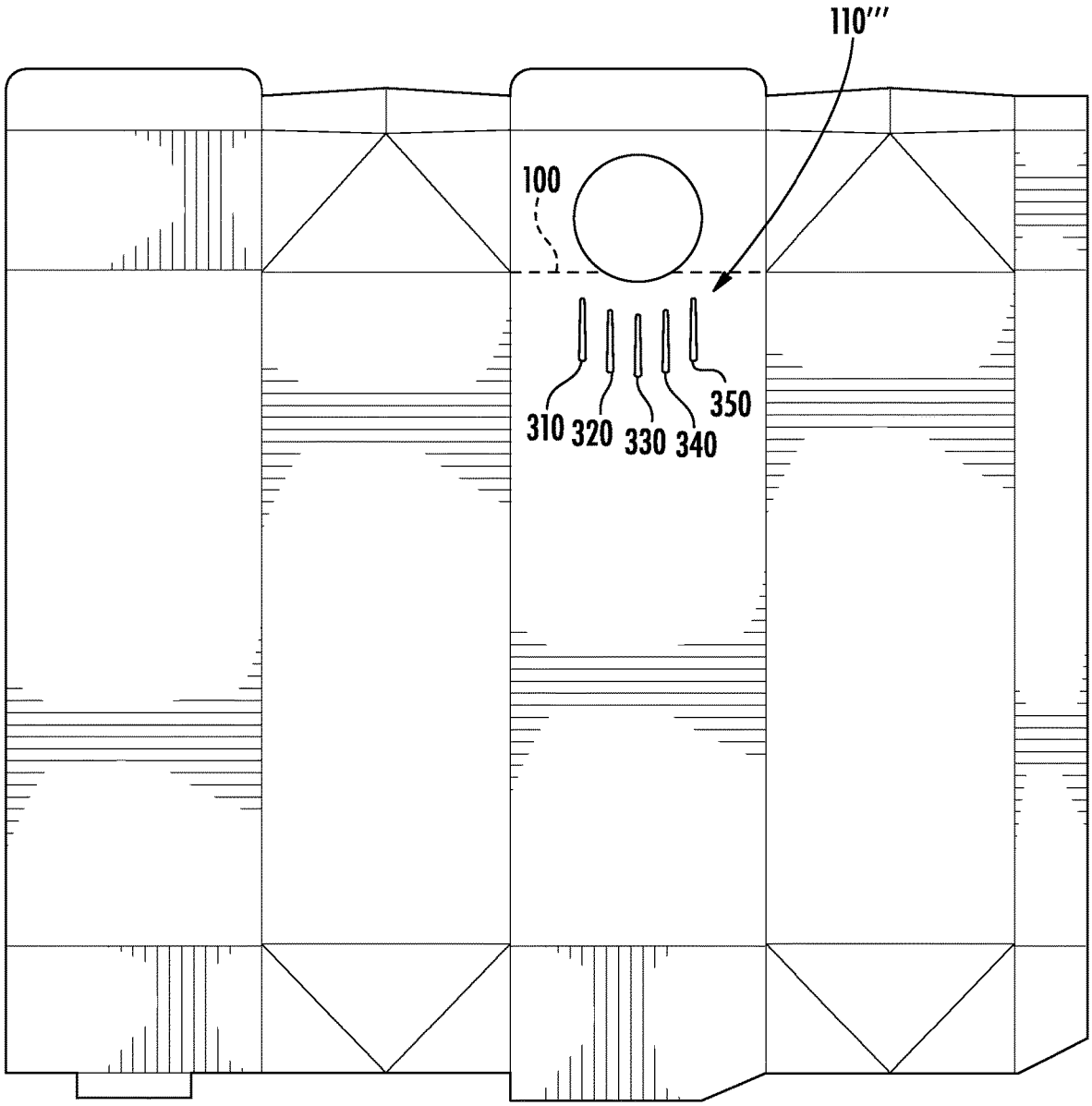
FIG. 9 is a fourth alternative construction of a unitary blank of paperboard for forming the gable top container of this invention utilizing scoring below the spout closure opening.
Figure 10:
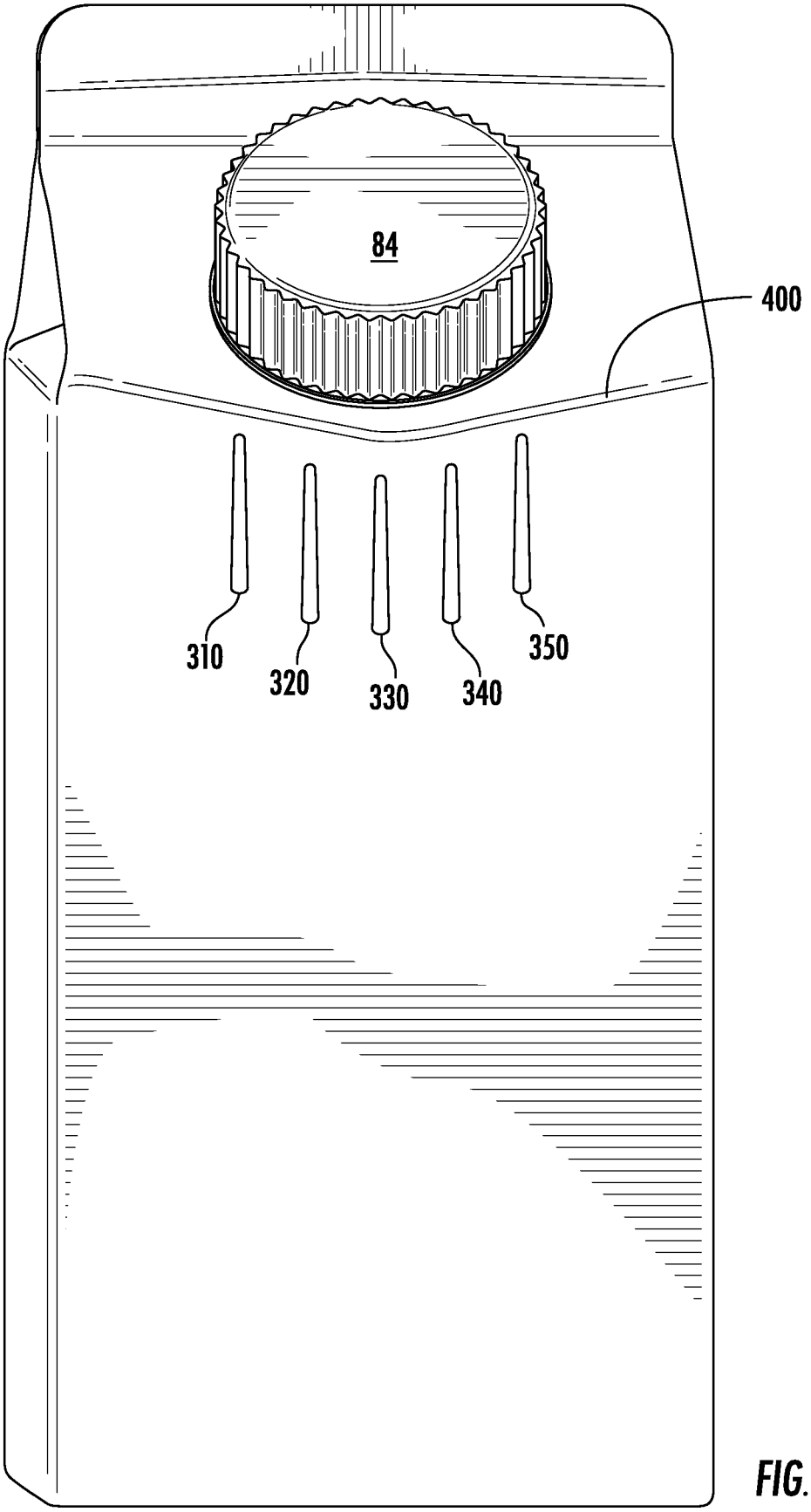
FIG. 10 a view illustrating the top of a container fashioned from the blank of FIG. 9 after it has been heat sealed and set up to form a carton with spout closure.

As seen in reference to the carton blank set forth in FIG. 9 and the assembled carton seen in FIG. 10, the score pattern 110'" is set forth in the wall panel beneath the spout closure opening. As seen in FIG. 9 each individual score 310, 320, 330, 340, and 350, forming the patterns is substantially parallel to each other and parallel to the edge walls defining the front panel. Similar to the embodiments in FIGS. 7 and 8, the score pattern 110'" can be made using individual scores having a varying width which is narrower at a proximal end and wider at a distal end. As seen in reference to FIG. 9, the middle score line 330 extends lower in a distal direction than the pair of score lines 320 and 340 on either side. The first pair of score lines are slightly raised relative to the proximal direction and are equal distant from the spout closure aperture 31. The outer most pair of score lines 310 and 350 are spaced from the spout closure aperture 31 such that the respective ends of the score line define a semi-circular pattern and are equidistance from an edge of the aperture 31.

The gable top carton seen in FIG. 10 may have a plurality of at least three score lines which are parallel to each and further parallel relative to the adjacent side wall edges which form the panel. The plurality of at least three score lines further defines a second terminal end, the width of the score line along the second terminal end being greater than a width of the score line at the first terminal end such that each score line has a width which, tapers from the second terminal end to the first terminal end. The pattern of score lines 110 is positioned wherein an extension of each score line intersects a circumferential edge of the closure cap 84.

The pattern 110'" has been found useful in allowing the carton blank having a closure affixed, to be folded into a assembled carton such that the score lines facilitate the distribution and release of pressure from the folding process and allows for an attractive front carton profile to be provided.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention and claims should not be limited to the description of the preferred versions contained therein.

The invention claimed is:

1. A carton blank adapted to be folded to a gable top carton comprising:

a first side wall panel, a second side wall panel, a third side wall panel and a fourth side wall panel;

a slanting roof panel positioned above the second side wall panel;

a first gusset panel positioned above the first side wall panel, and a second gusset panel positioned above the third side wall panel, wherein the first side wall panel and third side wall panels are adjacent to and on opposite sides of the second side wall panel;

a first linear score line comprising an intersection of the first gusset panel and the first side wall panel;

a second linear score line comprising an intersection of the second gusset panel and the third side wall panel;

a curved folding boundary area between the slanting roof panel and the second side wall panel defined by an extension of a plane extending between the first linear score line and the second linear score line when the blank is assembled in a folded condition, and wherein said curved folding boundary area extends into the second side wall panel;

an aperture extending across the curved folding boundary area between the slanting roof panel and the second side wall panel; and wherein there is no scoring in the folding boundary area.

2. A gable top carton comprising:

a first side wall panel, a second side wall panel, a third side wall panel and a fourth side wall panel, wherein the first side wall panel is sealed to the fourth side wall panel;

a plurality of bottom panels extending from a bottom end of one or more of the first, second, third or fourth side wall panels sealed to form a closed bottom;

a plurality of fin forming panels at a top edge of the carton, the fin forming panels sealed to form a closed top;

a slanting roof panel positioned above the second side wall panel;

a first gusset panel positioned above the first side wall panel, and a second gusset panel positioned above the third side wall panel, wherein the first side wall panel and third side wall panels are adjacent to and on opposite sides of the second side wall panel;

a first linear score line comprising an intersection of the first gusset panel and the first side wall panel;

a second linear score line comprising an intersection of the second gusset panel and the third side wall panel;

a curved folding boundary area between the slanting roof panel and the second side wall panel defined by an extension of a plane extending between the first linear score line and the second linear score line, wherein said curved folding boundary area extends into the second side wall panel; and an aperture extending across the curved folding boundary area between the slanting roof panel and the second side wall panel;

wherein the second side wall panel further comprises a plurality of single score lines each having a terminal end pointing toward and perpendicular to the aperture and spaced an equal distance and in a radial pattern from the aperture; and wherein there is no scoring in the folding boundary area.

3. The blank of claim 1 further comprising a plurality of single score lines in the second side wall panel, each having a terminal end pointing toward and perpendicular to the aperture and spaced an equal distance and in a radial pattern from the aperture.

4. The blank of claim 2 wherein each of single score lines has a tapering width tapering to a narrower width closest the aperture.

5. The blank of claim 2 wherein there a five single score lines.

6. The blank of claim 1 further comprising a plurality of single score lines in the second side wall panel comprising:

a first score line and a second score line wherein the first score line intersects a midpoint of the second score line.

7. The blank of claim 6, wherein the first score line and the second score line intersect to form a first angle A and a second angle A' that are less than or equal to 45 degrees.

8. The blank of claim 7, wherein the plurality of single score lines in the second side wall further comprises a third score line located proximate to the first score line and the second score line.

9. The blank of claim 1, further comprising a plurality of single score lines in the second side wall including:

a first score line that forms a first chevron having a first apex and a first free end opposite the first apex;

a second score line that forms a second chevron having a second apex and a second free end opposite the second apex.

10. The blank of claim 9, wherein the first apex of the first chevron is located opposite the second apex of the second chevron.

11. The blank of claim 9, wherein a third score line forms a third chevron having a third apex and a third free end and a fourth score line forms a fourth chevron having a fourth apex and a fourth free end.

12. The blank of claim 11, wherein the third apex of the third chevron is located opposite the fourth apex of the fourth chevron.

13. The blank of claim 11, wherein the first chevron and the third chevron overlap to define an angle D that is substantially equal to an angle C defined by an interior angle of the first apex of the first chevron.

14. The blank of claim 13, wherein the second chevron and the fourth chevron overlap to define an angle D' that is substantially equal to an angle C" defined by an interior angle of the second apex of the second chevron.

15. The blank of claim 1, further comprising a plurality of single score lines in the second side wall including:

a first score line, a second score, line, and third score line;

wherein a first terminal end of the first score line and a first terminal end of the second score line are spaced apart by a first distance and the first terminal end of the second score line and the a first terminal end of the third score line are spaced apart by a second distance; and wherein the first distance is substantially equal to the second distance.

16. The blank of claim 15, wherein the first terminal end of the first score line has a first width and a second terminal end of the first score line has a second width that is greater than the first width.

17. The blank of claim 16, wherein the first score line is tapered between the second terminal end and the first terminal end.

18. The blank of claim 15, wherein the first score line has a second terminal end and the second score line has a second terminal end that are separated by a third distance; and wherein the first distance is less than the third distance.

19. The blank of claim 15, wherein the first score line, the second score line, and the third score line are tangential to a surface of a plane of a circumference defined by the aperture.

20. The blank of claim 19, wherein the first terminal end of the first score line has a first width and a second terminal end of the first score line has a second width that is greater than or equal to the first width.

21. The blank of claim 20, wherein the first score line is tapered between the second terminal end and the first terminal end.

22. The blank of claim 2 wherein each of single score lines has a tapering width tapering to a narrower width closest the aperture.

23. The blank of claim 2 wherein there a five single score lines.

* * * * *